US008607605B2

(12) United States Patent
Tange et al.

(10) Patent No.: US 8,607,605 B2
(45) Date of Patent: Dec. 17, 2013

(54) MANUFACTURING METHOD FOR COIL SPRING

(75) Inventors: Akira Tange, Yokohama (JP); Hideki Okada, Yokohama (JP); Motoi Uesugi, Yokohama (JP); Yosuke Hisano, Yokohama (JP)

(73) Assignee: NHK Spring Co., Ltd., Tokyo (JP)

( * ) Notice: Subject to any disclaimer, the term of this patent is extended or adjusted under 35 U.S.C. 154(b) by 0 days.

(21) Appl. No.: 13/294,321

(22) Filed: Nov. 11, 2011

(65) Prior Publication Data

US 2012/0055216 A1 Mar. 8, 2012

Related U.S. Application Data

(63) Continuation of application No. PCT/JP2010/054689, filed on Mar. 18, 2010.

(30) Foreign Application Priority Data

Jun. 17, 2009 (JP) ..... 2009-144461

(51) Int. Cl.
*C21D 7/06* (2006.01)

(52) U.S. Cl.
USPC ..... 72/53; 29/90.7; 451/38; 451/39

(58) Field of Classification Search
USPC ..... 72/53; 29/90.7; 451/38
See application file for complete search history.

(56) References Cited

U.S. PATENT DOCUMENTS

| | | | | |
|---|---|---|---|---|
| 3,073,022 | A * | 1/1963 | Bush et al. | 72/53 |
| 4,067,240 | A * | 1/1978 | Straub | 72/377 |
| 4,428,213 | A * | 1/1984 | Neal et al. | 72/53 |
| 5,816,088 | A * | 10/1998 | Yamada et al. | 72/53 |
| 6,022,427 | A | 2/2000 | Wienand et al. | |
| 6,346,157 | B1 | 2/2002 | Takezawa et al. | |

(Continued)

FOREIGN PATENT DOCUMENTS

| | | | |
|---|---|---|---|
| CN | 1607995 | A | 4/2005 |
| JP | 63-076730 | A | 4/1988 |

(Continued)

OTHER PUBLICATIONS

Japanese Office Action dated Jul. 3, 2012 and English translation thereof in counterpart Japanese Application No. 2009-144461.

(Continued)

*Primary Examiner* — Dana Ross
*Assistant Examiner* — Homer Boyer
(74) *Attorney, Agent, or Firm* — Holtz, Holtz, Goodman & Chick, PC

(57) ABSTRACT

A spring wire is subjected to a first shot peening process and a second shot peening process. In the first shot peening process, a first shot is projected on the spring wire at a first projectile speed. High kinetic energy of the first shot produces compressive residual stress in a region ranging from the surface of the spring wire to a deep position. In the second spring wire process, a second shot is projected at a second projectile speed lower than the speed of the first shot. The kinetic energy of the second shot is lower than that of the first shot. The low kinetic energy of the second shot increases the compressive residual stress in a region near the surface of the spring wire.

6 Claims, 5 Drawing Sheets

(56) References Cited

U.S. PATENT DOCUMENTS

| | | | | |
|---|---|---|---|---|
| 6,544,360 | B1 * | 4/2003 | Tange et al. | 148/580 |
| 6,811,149 | B1 * | 11/2004 | Johnson | 267/167 |
| 6,932,876 | B1 * | 8/2005 | Statnikov | 148/558 |
| 7,284,308 | B2 | 10/2007 | Akeda et al. | |
| 7,568,368 | B2 * | 8/2009 | Scarlin et al. | 72/53 |
| 7,582,174 | B2 * | 9/2009 | Vigneau | 148/565 |
| 7,677,070 | B2 * | 3/2010 | Kobayashi | 72/53 |
| 7,699,943 | B2 * | 4/2010 | Nakano et al. | 148/333 |

FOREIGN PATENT DOCUMENTS

| | | | |
|---|---|---|---|
| JP | 5-177544 | A | 7/1993 |
| JP | 11-114827 | A | 4/1999 |
| JP | 2000-345238 | A | 12/2000 |
| JP | 2003-117830 | A | 4/2003 |
| JP | 2005-2365 | A | 1/2005 |
| JP | 2005-3074 | A | 1/2005 |
| JP | 2008-106365 | A | 5/2008 |
| JP | 2009-226523 | A | 10/2009 |
| WO | WO 03/055643 | A1 | 10/2003 |

OTHER PUBLICATIONS

International Search Report dated Jun. 8, 2010 (in English) in counterpart International Application No. PCT/JP2010/054689.

International Preliminary Report on Patentability (IPRP) dated Jan. 26, 2012 (in English) issued in parent International Application No. PCT/JP2010/054689.

Japanese Office Action dated Jun. 25, 2013 (and English translation thereof) in counterpart Japanese Application No. 2009-144461.

Chinese Office Action dated Jun. 26, 2013 (and English translation thereof) in counterpart Chinese Application No. 201080027429.X.

* cited by examiner ( REFERENCE FIGURE )

MANUFACTURING METHOD FOR COIL SPRING

CROSS REFERENCE TO RELATED APPLICATIONS

This application is Continuation Application of PCT Application No. PCT/JP2010/054689, filed Mar. 18, 2010 and based upon and claiming the benefit of priority from prior Japanese Patent Application No. 2009-144461, filed Jun. 17, 2009, the entire contents of all of which are incorporated herein by reference.

BACKGROUND OF THE INVENTION

1. Field of the Invention

This invention relates to a manufacturing method for a coil spring used in, for example, a suspension mechanism of a vehicle, and more particularly, to shot peening conditions.

2. Description of the Related Art

It is conventionally known that the fatigue strength of a coil spring can be improved by applying compressive residual stress to the vicinity of the surface of the spring by shot peening. Multistage shot peening is disclosed in Jpn. Pat. Appln. KOKAI Publication No. 2000-345238 or Jpn. Pat. Appln. KOKAI Publication No. 2008-106365. In the multistage shot peening, a plurality of shot peening cycles are performed separately. Further, stress peening and warm peening (hot peening) are also known as means for producing compressive residual stress in a region ranging from the surface of the spring to a deep region. In the stress peening, the coil spring is compressed as a shot is projected. In the warm peening, the coil spring is heated to a temperature of about 250° C. as a shot is projected.

The stress peening requires equipment for compressing the coil spring. Since the coil spring is compressed as the shot is projected, moreover, the intervals between the turns of the spring wire become shorter. Accordingly, there is a problem that shots cannot be easily applied to the inside of the coil spring or between the spring wire turns. In the warm peening, a desired residual stress distribution cannot be obtained unless the temperature is appropriately maintained, so that temperature control is difficult.

Possibly, on the other hand, the fatigue strength of the coil spring may be improved by adding a specific alloy component to spring steel. However, spring steel containing a specific alloy component is expensive and causes an increase in the cost of the coil spring.

BRIEF SUMMARY OF THE INVENTION

Accordingly, the object of the present invention is to provide a manufacturing method for a coil spring, in which fatigue strength can be further improved by two-stage shot peening.

A manufacturing method for a coil spring of the present invention comprises a first shot peening process and a second shot peening process to be performed after the first shot peening process. In the first shot peening process, a first shot is caused to impinge on a spring wire at a first projectile speed, whereby a compressive residual stress is produced such that a peak part of the compressive residual stress exists within the spring wire. In the second shot peening process, a second shot is caused to impinge on the spring wire at a second projectile speed lower than the first projectile speed and with kinetic energy lower than that of the first shot. By this second shot peening process, the compressive residual stress in a region near the surface is increased to be higher than the peak part of the compressive residual stress.

According to the present invention, a more effective compressive residual stress distribution for the improvement of the fatigue strength of the coil spring can be obtained by the first shot peening process with high kinetic energy, produced by high-speed impingement of the first shot, and the second shot peening process with low kinetic energy, produced by low-speed impingement of the second shot. In the second shot peening process, moreover, the rotational speed of an impeller can be made lower than in the first shot peening process, so that noise, vibration, and power consumption can be reduced.

In the present invention, the size of the second shot may be smaller than that of the first shot. Alternatively, the size of the second shot may be equal to that of the first shot. In either case, the kinetic energy of the second shot is made lower than that of the first shot by making the projectile speed of the second shot lower (slower) than that of the first shot. Further, the first shot peening process and the second shot peening process should preferably be performed at treatment temperatures from 150 to 350° C.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A coil spring according to one embodiment of the present invention and a manufacturing method therefor will now be described with reference to the drawings.

Figure 1:
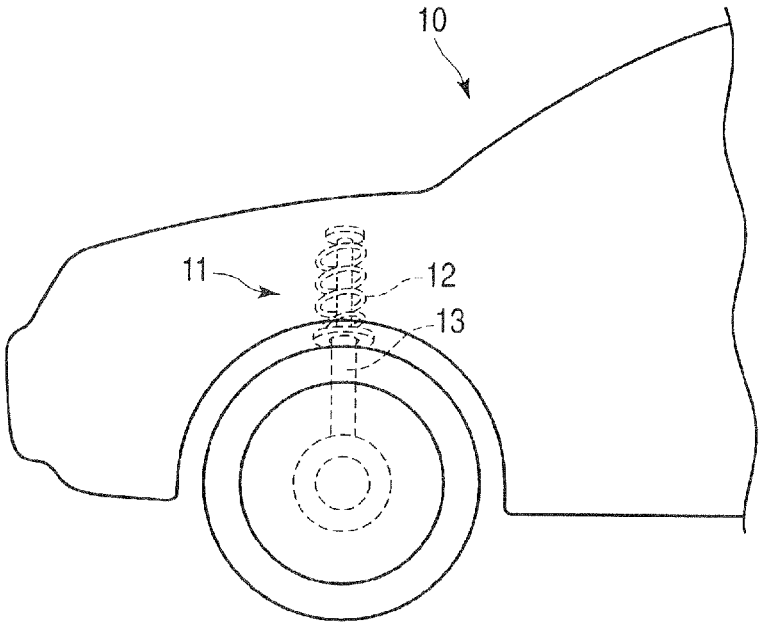
FIG. 1 is a side view of a part of an automobile comprising a coil spring according to one embodiment of the present invention.
Figure 2:
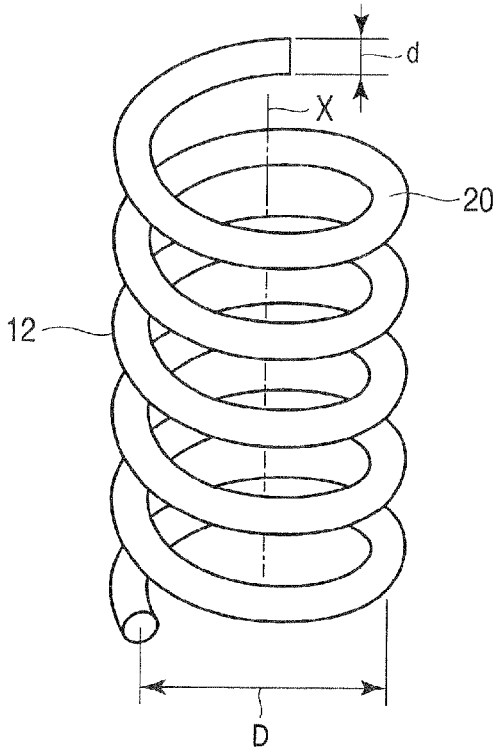
FIG. 2 is a perspective view of the coil spring shown in FIG. 1.

A suspension mechanism 11 of a vehicle 10 shown in FIG. 1 comprises a coil spring and shock absorber 13. In the coil spring 12 shown in FIG. 2, a spring wire 20 is formed into a spiral. This coil spring 12 is compressed along an axis X as it elastically supports the load of the vehicle 10.

An example of the coil spring 12 is a cylindrical coil spring. An example of the wire diameter d (shown in FIG. 2) of the spring wire 20 is 12.5 mm. A mean coil diameter D, free length (unloaded length), number of active turns, and spring constant are 110.0 mm, 382 mm, 5.39, and 33.3 N/mm, respectively. While the prevailing wire diameter of the coil spring 12 ranges from 8 to 21 mm, it may be replaced with other diameters. Further, the coil spring may be any of various forms, such as a barrel coil spring, hourglass coil spring, tapered coil spring, irregular-pitch coil spring, load-axis-control coil spring, and the like.

Example 1

Steel that forms the spring wire 20 is highly corrosion-resistant spring steel (referred to as spring steel S for convenience in this description). The spring steel S is a type of steel enhanced in corrosion resistance, and its chemical composition (mass %) is 0.41 carbon, 1.73 silicon, 0.17 manganese, 0.53 nickel, 1.05 chromium, 0.163 vanadium, 0.056 titanium, 0.21 copper, and iron for the remainder.

Figure 3:
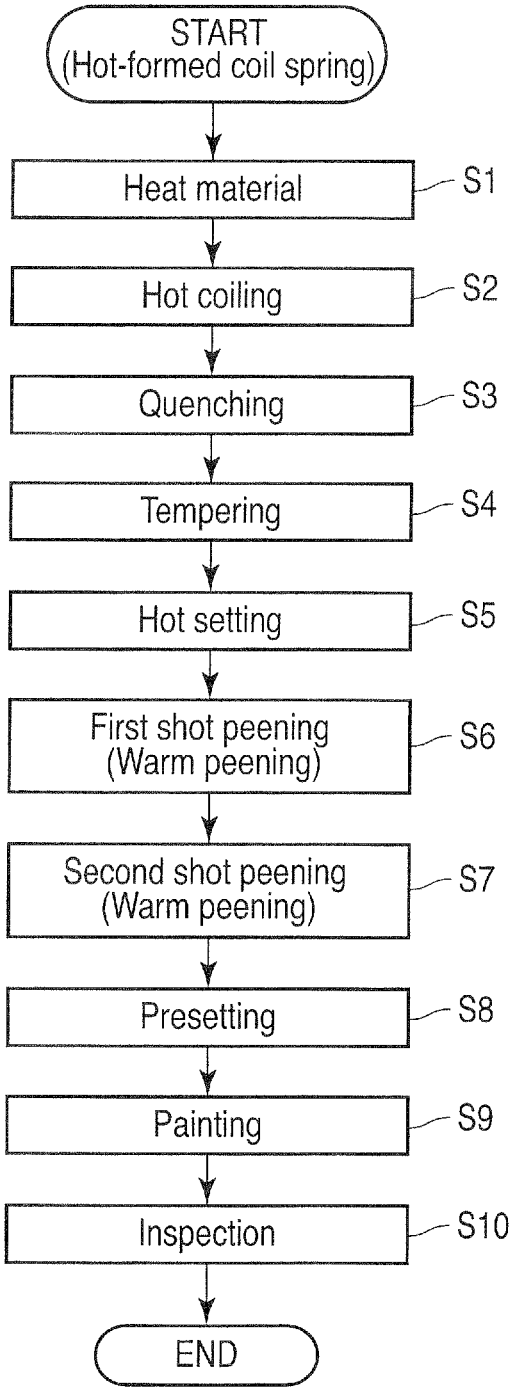
FIG. 3 is a flowchart showing an example of a manufacturing process for the coil spring shown in FIG. 2.

FIG. 3 shows manufacturing processes for a hot-formed coil spring. In a heating process S1, a spring wire for use as a material of the coil spring is heated to the austenitizing temperature (from $A_3$ transformation point to 1,150° C.). The heated spring wire is bent into a spiral in a bending process (coiling process) S2. Thereafter, a heat treatment, including a quenching process S3, tempering process S4, etc., is performed.

The spring wire is thermally refined by the heat treatment so that its hardness ranges from 50 to 56 HRC. For example, a coil spring with a maximum design stress of 1,300 MPa is thermally refined so that its hardness is 54.5 HRC. A coil spring with a maximum design stress of 1,200 MPa is thermally refined so that its hardness is 53.5 HRC. In a hot setting process S5, an axial load is applied to the coil spring for a predetermined time. The hot setting process S5 is performed as warm working by using residual heat after the heat treatment.

Thereafter, a first shot peening process S6 is performed. A first shot (cut wire of iron) with a shot size (particle size) of 1.0 mm is used in the first shot peening process S6. This first shot is projected on the spring wire at a treatment temperature of 230° C. and a speed of 76.7 m/sec (impeller speed of 2,300 rpm) and with kinetic energy of $12.11\times10^{-3}$ J.

The projectile speed of the shot is a value obtained by multiplying a peripheral speed, which depends on the diameter and rotational speed of an impeller of a shot peening device, by 1.3. If the impeller diameter and impeller speed are, for example, 490 mm and 2,300 rpm, respectively, the projectile speed is 1.3×0.49×3.14×2,300/60=76.7 m/sec.

In the first shot peening process S6, the first shot is caused to impinge on the spring wire at a first projectile speed. Thus, the first shot having high kinetic energy produces compressive residual stress in a region ranging from the surface of the spring wire to a deep position in the depth direction. The surface roughness of the spring wire in the first shot peening process S6 should preferably be 75 μm or less.

After the first shot peening process S6 is performed, a second shot peening process S7 is performed. A second shot smaller than the first shot is used in the second shot peening process S7. The shot size (particle size) of the second shot is 0.67 mm. This second shot is projected on the spring wire at a treatment temperature of 200° C. and a speed of 46 m/sec (impeller speed of 1,380 rpm) and with kinetic energy of $1.31\times10^{-3}$ J.

Thus, in Example 1, the kinetic energy of the second shot used in the second shot peening process S7 is made smaller than that of the first shot used in the first shot peening process S6. In addition, the projectile speed of the second shot is made lower (slower) than that of the first shot.

As a means for making the projectile speed of the second shot lower than that of the first shot, inverter control may be performed, for example, to change the speed of a motor for rotating an impeller. Alternatively, the gear ratio of a reduction gear mechanism disposed between the motor and impeller may be changed.

Table 1 shows data based on comparison between the kinetic energies of the shots under shot peening conditions. If the shot size is large, the kinetic energy increases without change of the projectile speed. The kinetic energy of a large shot with a shot size of, for example, 1 mm is about 1.5-times that of a 0.87-mm shot. The kinetic energy of a large shot with a shot size of 1.1 mm is about twice that of the 0.87-mm shot. In contrast, the kinetic energy of a small shot with a shot size of 0.67 mm is half that of the 0.87-mm shot if the projectile speed is fixed. The kinetic energy of a shot with a shot size of 0.4 mm is lower than that of the 0.67-mm shot even if the projectile speed is almost doubled.

TABLE 1

| Shot size (mm) | Impeller speed (rpm) | Projectile speed (m/s) | Kinetic energy (J) | Ratio of energy |
|---|---|---|---|---|
| 1.10 | 2300 | 76.7 | 0.01612 | 2.02 |
| 1.00 | 2300 | 76.7 | 0.01211 | 1.52 |
| 0.87 | 2300 | 76.7 | 0.00797 | 1.00 |
| 0.67 | 2300 | 76.7 | 0.00364 | 0.46 |
| 0.67 | 1380 | 46.0 | 0.00131 | 0.16 |
| 0.40 | 2600 | 86.7 | 0.00099 | 0.12 |

Treatment temperatures for the first shot peening process S6 and second shot peening process S7 suitably range from 150 to 350° C. Thus, warm peening (hot peening) is performed by using residual heat after the heat treatment. Moreover, the second shot peening process S7 is performed at a treatment temperature lower than that of the first shot peening process S6.

According to the shot peening processes S6 and S7 of Example 1, unlike the conventional stress peening, high compressive residual stress can be produced in a region ranging from the surface to a deep position without compressing the coil spring. Therefore, it is unnecessary to provide equipment for compressing the coil spring, such as the one required by the stress peening. Since the intervals between the turns of the spring wire do not become shorter, unlike in the case of the stress peening, moreover, shots can be sufficiently applied to the inside of the coil spring or between the spring wire turns.

After the shot peening processes S6 and S7 in the two stages are performed, a presetting process S8 and painting process S9 are performed. Thereafter, an inspection process S10 is performed to inspect the coil spring for appearance, properties, etc. The presetting process S8 may be omitted.

Figure 4:
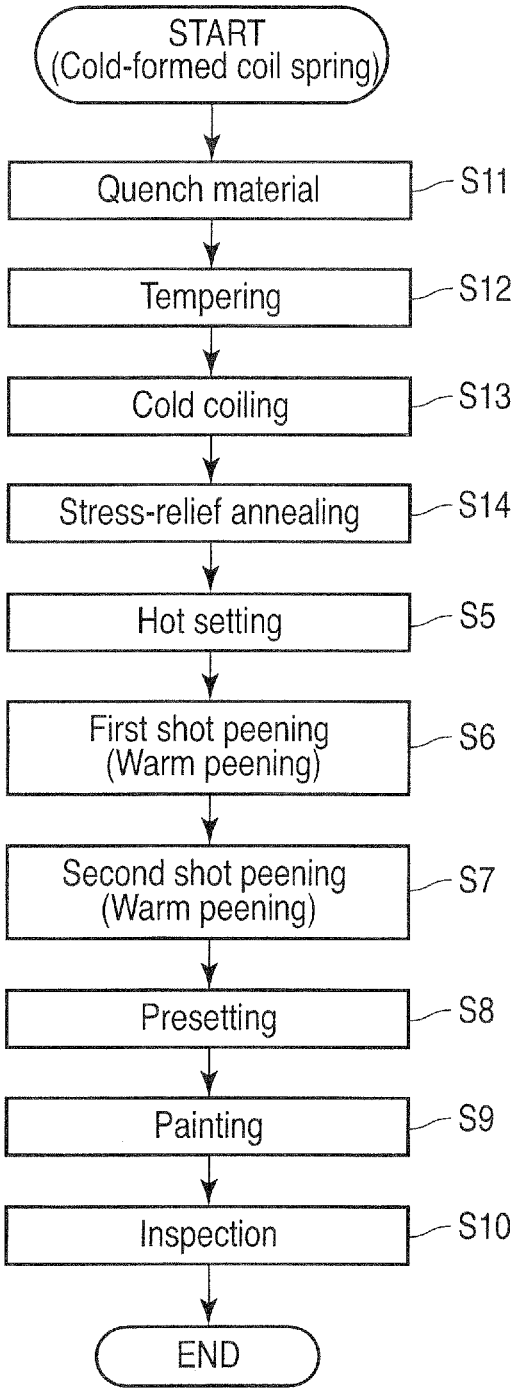
FIG. 4 is a flowchart showing another example of the manufacturing process for the coil spring shown in FIG. 2.

FIG. 4 shows manufacturing processes for the case where the coil spring is cold-coiled. As shown in FIG. 4, the spring wire to be coiled is previously subjected to a heat treatment, including a quenching process S11, tempering process S12, etc. This spring wire is cold-formed into a spiral in a bending process (coiling process) S13. In a stress-relief annealing process S14, thereafter, the coil spring is left as it is in an atmosphere at a predetermined temperature for a predetermined time, whereby a processing strain produced during formation is removed.

As in the case of the hot-formed coil spring of FIG. 3, this coil coiling comprises a hot setting process S5, first shot peening process S6, second shot peening process S7, presetting process S8, painting process S9, and inspection process S10. The coil spring may warm-coiled. Further, the presetting process S8 may be omitted.

Figure 5:
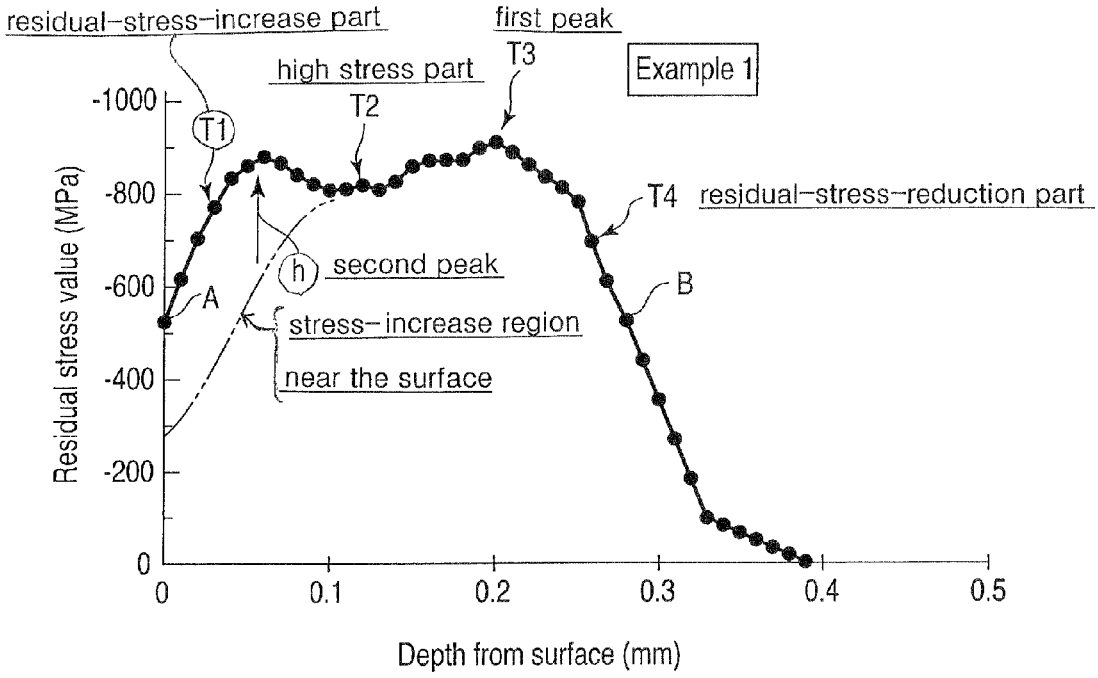
FIG. 5 is a graph showing a compressive residual stress distribution of Example 1 according to the present invention.

FIG. 5 shows a compressive residual stress distribution of the coil spring of Example 1. The abscissa of FIG. 5 represents the position in the depth direction from the surface of the spring wire. While the ordinate of FIG. 5 represents the residual stress value, the compressive residual stress value is expressed as negative according to the custom in the art. For example, −400 MPa or more means that the absolute value is 400 MPa or more. While a tensile residual stress value is expressed as positive, it is not shown in FIG. 5.

As shown in FIG. 5, the compressive residual stress of the coil spring of Example 1 comprises a residual stress increase part T1, high-stress part T2, residual stress peak T3, and residual stress reduction part T4. In the residual stress increase part T1, the compressive residual stress increases in the depth direction from the surface of the spring wire toward the inside of the spring wire. In the high-stress part T2, the compressive residual stress is maintained at a high level. In the residual stress peak part T3, the compressive residual stress is maximal. In the residual stress reduction part T4, the compressive residual stress is reduced in the depth direction of the spring wire from the residual stress peak part T3.

In Example 1, as described above, the two-stage shot peening (warm double shot peening) based on the first shot peening process S6 and second shot peening process S7 is performed. Specifically, in the first shot peening process S6 of the first stage, the compressive residual stress is produced in a region ranging from the surface to a deep position by the high kinetic energy of the high speed first shot.

In the second shot peening process S7 of the second stage, low kinetic energy of the low speed second shot increases the compressive residual stress nearer to the surface than the compressive residual stress peak part T3, as indicated by arrow h in FIG. 5. Thus, a residual stress distribution can be obtained such that the compressive residual stress is maintained at a high level throughout a region from the vicinity of the surface to a deep position.

As described before, the first shot with high kinetic energy is used in the first shot peening process S6, and the second shot with low kinetic energy is used in the second shot peening process S7. In addition, the projectile speed of the second shot is made lower than that of the first shot. Therefore, the surface roughness of the spring wire that is increased by the first shot peening process S6 can be reduced by the second shot peening process S7, so that the surface state of the spring wire can be improved.

Example 2

The type of steel of a spring wire is SUP7 conforming to Japanese Industrial Standards (JIS). The chemical composition (mass %) of SUP7 is 0.56 to 0.64 carbon, 1.80 to 2.20 silicon, 0.70 to 1.00 manganese, 0.035 or less phosphorus, 0.035 or less sulfur, and iron for the remainder. Manufacturing processes of Example 2 are shared with Example 1 except for the shot peening conditions. The two-stage shot peening (warm double shot peening) based on a first shot peening process and second shot peening process is also performed in Example 2.

In the first shot peening process in Example 2, a first shot with a shot size of 0.87 mm was caused to impinge on the spring wire at a first projectile speed of 76.7 m/sec (impeller speed of 2,300 rpm). The treatment temperature is 230° C. In the second shot peening process, thereafter, a second shot with a shot size of 0.67 mm was caused to impinge on the spring wire at a second projectile speed of 46 m/sec (impeller speed of 1,380 rpm). The treatment temperature is 200° C. Thus, in Example 2, as in Example 1, the projectile speed and kinetic energy of the second shot were made lower than those of the first shot.

Figure 6:
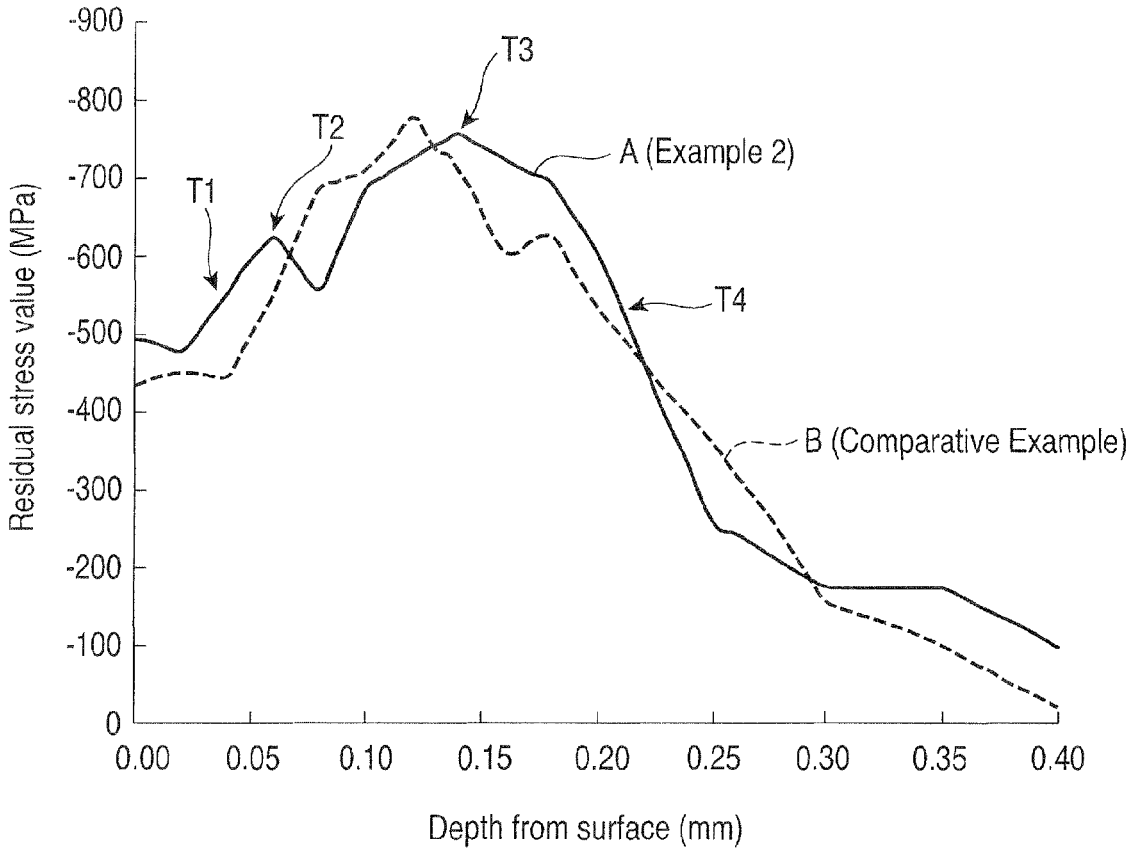
FIG. 6 is a graph showing compressive residual stress distributions of Example 2 according to the present invention and Comparative Example.

In FIG. 6, full line A represents a compressive residual stress distribution of the coil spring of Example 2. The coil spring of Example 2, like that of Example 1, also comprises a residual stress increase part T1, high-stress part T2, residual stress peak T3, and residual stress reduction part T4. In the residual stress increase part T1, the compressive residual stress increases in the depth direction from the surface of the spring wire. In the high-stress part T2, the compressive residual stress is maintained at a high level. In the residual stress peak part T3, the compressive residual stress is maximal. In the residual stress reduction part T4, the compressive residual stress is reduced in the depth direction of the spring wire from the residual stress peak part T3.

In Example 2, as in Example 1, the compressive residual stress is also produced in a deep region of the spring wire by the high kinetic energy of the first shot in the first shot peening process. Further, the compressive residual stress near the surface of the spring wire is increased by the low kinetic energy of the low-speed second shot in the second shot peening process.

Comparative Example

The type of steel of a spring wire is SUP7, the same material used in Example 1. Manufacturing processes are shared with Example 2 except for the projectile speed of the second shot used in the second shot peening process. Specifically, according to Comparative Example, a first shot with the shot size of 0.87 mm was projected on the spring wire at the first projectile speed of 76.7 m/sec (impeller speed of 2,300 rpm) in a first shot peening process. The treatment temperature is 230° C. Then, in the second shot peening process, a second shot with the shot size of 0.67 mm was projected on the spring wire at the same projectile speed of 76.7 m/sec (impeller speed of 2,300 rpm) of the first shot. The treatment temperature is 200° C. In FIG. 6, broken line B represents a compressive residual stress distribution of Comparative Example.

When both Example 2 and Comparative Example were each subjected to a fatigue test (735±520 MPa) in the atmosphere, Comparative Example fractured after 100,000 load cycles, while Example 2 fractured after 200,000 load cycles, which indicates an approximate doubling of fatigue life. Since the projectile speed of the second shot is made equal to that of the first shot in Comparative Example, such a residual stress distribution that provides fatigue strength (durability in the atmosphere) equivalent to that of Example 2 was not able to be obtained.

If the size of the second shot is reduced to, for example, 0.4 mm and if its projectile speed is increased to, for example, 86.7 m/sec (impeller speed of 2,600 rpm), the kinetic energy of the second shot can be approximated to that of Example 2. If the projectile speed is thus increased, however, the impeller speed increases, whereupon problems occur such that noise or vibration, power consumption, and wear of the device increase. Thus, increasing the projectile speed is not suitable for mass production (practical application).

In Examples 1 and 2, in contrast, the compressive residual stress near the surface is increased by making the projectile speed of the second shot lower (slower) than that of the first shot. Accordingly, wear of the shot peening device, as well as noise or vibration and power consumption, can be reduced. Thus, manufacturing costs can be reduced.

In the second shot peening process of either of Examples 1 and 2, moreover, the second shot is smaller than that used in the first shot peening process, and the second projectile speed is lower than the first projectile speed. Therefore, the surface roughness of the spring wire can be reduced, so that the surface state of the spring wire can be improved. This is also conducive to the improvement of the fatigue strength (durability in the atmosphere).

The first shot used in the first shot peening process and the second shot used in the second shot peening process may be made equal in size. In short, the kinetic energy of the second shot should only be made lower than that of the first shot by making the projectile speed of the second shot lower (slower) than that of the first shot.

Effects produced by the examples described above have the same tendencies irrespective of the types of steel, and the fatigue strength can be improved by using spring steel that is conventionally used for a suspension coil spring. Thus, there is also such an effect that an increase in the material, cost of the coil spring can be suppressed. The coil spring according to the present invention is applicable to suspension mechanisms of various vehicles including automobiles.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A manufacturing method for a coil spring, the method comprising a first shot peening process and a second shot peening process to be performed after the first shot peening process, wherein:

the first shot peening process comprises causing a first shot to impinge on a surface of a spring wire at a first projectile speed and at a first treatment temperature, thereby producing a compressive residual stress within the spring wire, wherein the first shot peening process forms (i) a first peak in which a maximum absolute value of the compressive residual stress exists within the spring wire, (ii) a high stress part next to the first peak and nearer to the surface than the first peak, (iii) a stress-increase region near the surface in which an absolute value of the compressive residual stress increases from the surface toward the high stress part, and (iv) a residual-stress-reduction part in which an absolute value of the compressive residual stress decreases from the first peak in a depth direction of the spring wire; and the second shot peening process comprises causing a second shot to impinge on the surface of the spring wire at a second projectile speed lower than the first projectile speed, at a second treatment temperature that is lower than the first treatment temperature, and with a kinetic energy lower than that of the first shot, thereby increasing an absolute value of the compressive residual stress of the stress-increase region near the surface and forming, between the surface and the high stress part, (v) a second peak in which an absolute value of the compressive residual stress is greater than that of the high stress part, and (vi) a residual-stress-increase part in which an absolute value of the compressive residual stress increases from the surface toward the second peak.

2. The manufacturing method for a coil spring according to claim 1, wherein the size of the second shot is smaller than that of the first shot.

3. The manufacturing method for a coil spring according to claim 1, wherein the size of the second shot is equal to that of the first shot.

4. The manufacturing method for a coil spring according to claim 1, wherein each of the first and second treatment temperatures is between 150 and 350° C.

5. The manufacturing method for a coil spring according to claim 2, wherein each of the first and second treatment temperatures is between 150 and 350° C.

6. The manufacturing method for a coil spring according to claim 3, wherein each of the first and second treatment temperatures is between 150 and 350° C.

* * * * *